United States Patent [19]

Brand et al.

[11] 3,973,675

[45] Aug. 10, 1976

[54] PROTECTIVE WRAPPER FOR FLUORESCENT LAMPS AND SIMILAR FRAGILE ARTICLES, AND RESULTING PACKAGE

[75] Inventors: Lawrence W. Brand, Levittown, Pa.; Thomas Barbieri, Peapack; David McCalmont, Bloomfield, both of N.J.

[73] Assignee: Westinghouse Electric Corporation, Pittsburgh, Pa.

[22] Filed: Oct. 2, 1975

[21] Appl. No.: 619,106

Related U.S. Application Data

[63] Continuation of Ser. No. 182,622, Sept. 22, 1971.

[52] U.S. Cl. ..... 206/418; 229/14 C; 229/39 B

[51] Int. Cl.[2] ..... B65D 85/70; B65D 3/04; B65D 5/56

[58] Field of Search ..... 206/45.31, 68, 418, 206/421; 229/14 C, 39 B, 93

[56] References Cited

UNITED STATES PATENTS

| | | | |
|---|---|---|---|
| 2,654,472 | 10/1953 | White | 206/422 |
| 2,711,922 | 6/1955 | Batkin | 294/87.2 |
| 2,712,959 | 7/1955 | Tomarin | 294/87.2 |
| 2,798,596 | 7/1957 | Emmons | 206/418 |
| 2,870,949 | 1/1959 | Currivam | 229/14 C |
| 3,055,431 | 9/1962 | Jacobs | 229/39 B |
| 3,476,235 | 11/1969 | Mills et al. | 206/418 |
| 3,563,369 | 2/1971 | Aldrich | 206/45.14 |

FOREIGN PATENTS OR APPLICATIONS

| | | | |
|---|---|---|---|
| 521,271 | 1/1954 | Belgium | 206/418 |

*Primary Examiner*—Davis T. Moorhead
*Attorney, Agent, or Firm*—D. S. Buleza

[57] ABSTRACT

A fluorescent lamp or similary shaped fragile article is frictionally locked with a protective open-ended wrapper of tubular sleeve-like configuration by an inturned tab that constitutes a hinged part of the wrapper and is sandwiched between the inserted lamp and the wrapper wall. The wrapper is preferably fabricated from single-face corrugated paper and the tab is swingable about a hinge line such that the corrugations of the inturned tab extend transversely with respect to and thus do not nest with the corrugations of the wrapper, thereby enhancing the effectiveness of the tab as an integral article-retaining means.

9 Claims, 6 Drawing Figures

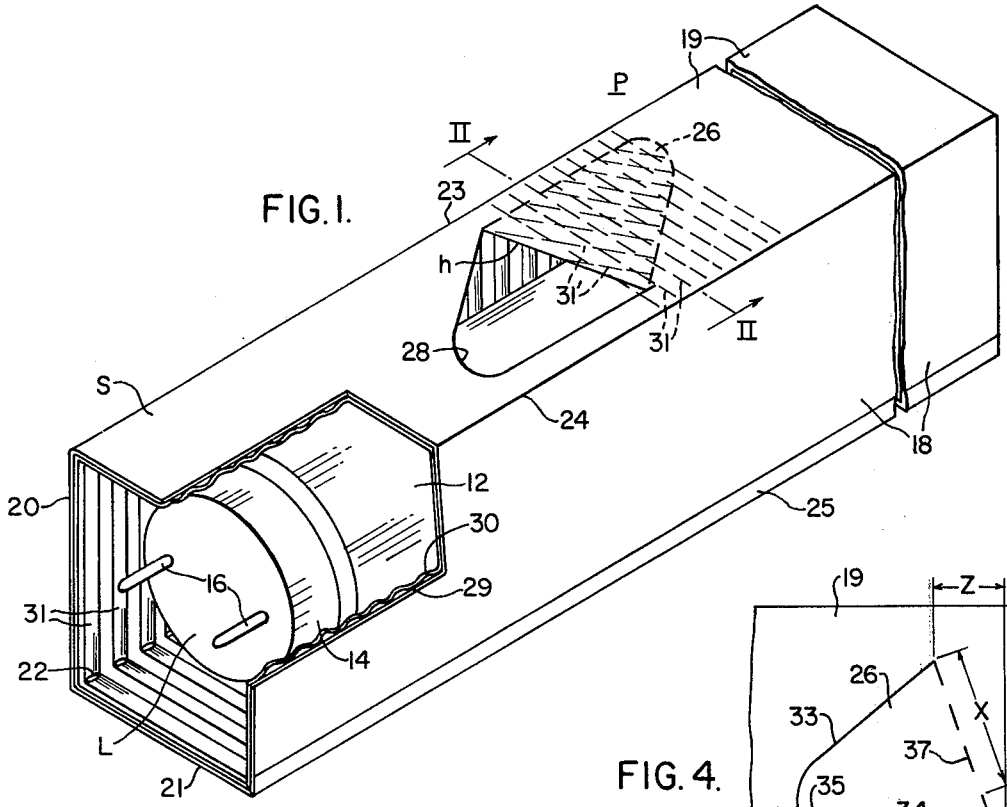
FIG. 1.
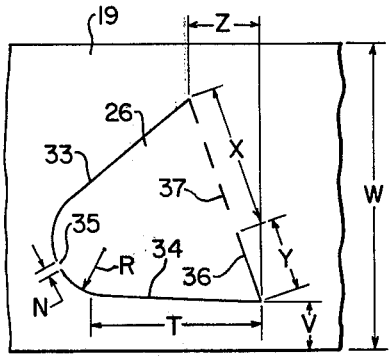
FIG. 4.
FIG. 2.
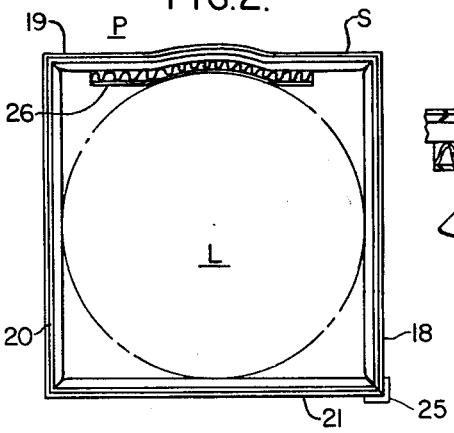
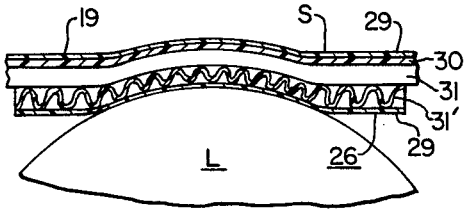
FIG. 3.
FIG. 6.
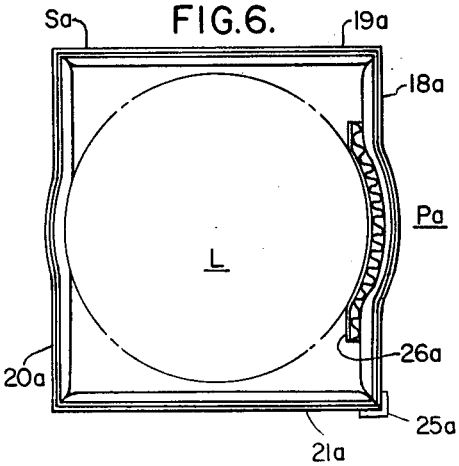
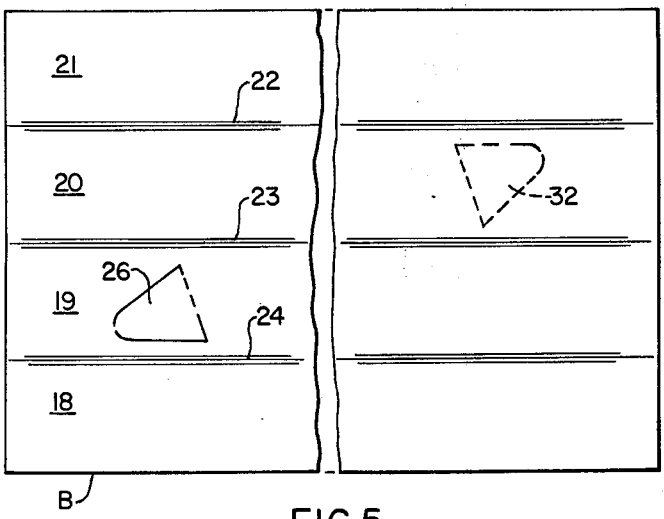
FIG. 5.

PROTECTIVE WRAPPER FOR FLUORESCENT LAMPS AND SIMILAR FRAGILE ARTICLES, AND RESULTING PACKAGE

CROSS-REFERENCE TO RELATED APPLICATIONS

This is a continuation of application Ser. No. 182,622, filed Sept. 22, 1971.

BACKGROUND OF THE INVENTION

1. Field of the Invention

The present invention relates to the art of packaging fragile articles and has particular reference to an improved paper wrapper for protectively packaging fluorescent lamps, and to the improved package which the wrapper provides.

2. Description of the Prior Art

As is well-known in the art, fluorescent lamps are generally protected from breakage during shipment and handling by an open-ended wrapper or sleeve or corrugated paper that is slipped over the lamp in the factory before the lamps are loaded into the shipping cartons. Such wrappers have four walls, are either square or rectangular in cross-section and, in either case, are dimensioned to effect a snug fit with the lamp envelopes and thus be frictionally locked in place. A wrapper of this type having paired walls of unequal width which define a rectangular cross-sectioned compartment is described and claimed in U.S. Pat. No. 3,476,235 issued Nov. 4, 1969 to J. E. Mills et al. Cartons having inturned hinged elements that serve as separators for a pair of nested light bulbs or as spacer means for a single bulb or radio tube are disclosed in U.S. Pat. Nos. 2,654,472; 2,870,949; 3,053,431, and 3,355,011.

While the prior art "slip-over" wrapper prevented the fluorescent lamps from contacting one another and breaking during shipment, additional protection against the danger of the lamp additionally slipping out of the wrapper while being handled by store personnel or prospective customers at the retail level would be highly desirable and advantageous for obvious reasons.

SUMMARY OF THE INVENTION

Briefly, the present invention provides this added protection by increasing the amount of frictional interlock between the inserted lamp or other article and the wrapper in a simple, economical and practical manner. This is accomplished by modifying one of the wrapper walls in such a way that a segment of the wall is converted into an inwardly-displaceable hinged article-retaining tab. This tab is inturned into the wrapper compartment just before the tubular article is inserted and is thus sandwiched between the packaged article and the wall of the wrapper. The wall thickness of the wrapper is accordingly doubled at this location — thereby greatly increasing the frictional grip of the wrapper on the inserted article and securely anchoring the latter in place.

In the case of fluorescent or other types of electric lamps, the wrappers or sleeves are fabricated from single-face corrugated paper and the hinged locking tab is cut or coined from the wrapper wall in such a fashion that it swings about a hinge line that extends transversely with regard to the corrugations on the inner surface of the wrapper. The corrugations of the inturned tab thus do not nest with but "bridge" those of the wrapper wall and the effective thickness of the wrapper in this region is proportionately increased. The improved wrapper thus has a "built-in" safeguard against accidental lamp slippage and breakage which is reliable and economical since it requires no additional packaging material and automatically achieves its objective upon being activated at the beginning of the packaging operation.

BRIEF DESCRIPTION OF THE DRAWINGS

A better understanding of the invention will be obtained from the exemplary embodiments shown in the accompanying drawing, wherein:

FIG. 1 is a fragmentary perspective view of a fluorescent lamp package according to the invention, a corner of the tabbed wrapper being removed to show the position of the packed lamp;

FIG. 2 is an enlarged sectional view of the tabbed portion of the wrapper along line II—II of FIG. 1, the lamp being shown in phantom outline;

FIG. 3 is an enlarged cross-sectional view of the tabbed portion of the wrapper and associated segment of the inserted lamp;

FIG. 4 is an enlarged plan view of the tabbed part of the wrapper before the tab is displaced from the plane of the wrapper wall;

FIG. 5 is a fragmentary plan view of the corrugated-paper blank from which the wrapper shown in FIGS. 1–4 is manufactured, an optional second tab being shown in dotted outline at the opposite end of the blank; and FIG. 6 is a sectional view similar to FIG. 2 showing an alternative embodiment wherein the integral locking tab of the present invention is employed with a lamp wrapper of rectangular cross-section.

DESCRIPTION OF THE PREFERRED EMBODIMENTS

While the present invention can be used with equal advantage in protectively packaging various types of fragile articles and electric lamps (such as "lumiline" incandescent lamps) that have at least one segment which is substantially circular in cross-section, it is especially adapted for use with tubular fluorescent lamps and it has accordingly been so illustrated and will be so described.

As shown in FIG. 1, the lamp package P in accordance with the present invention consists of an open-ended paper wrapper or sleeve S that is slipped over and protectively encloses the fluorescent lamp L. The lamp L has the usual tubular glass envelope 12 of circular cross-section and is terminated at each end by a suitable base member 14 and pin terminals 16. The sleeve S is fabricated from single-face corrugated paper that is divided into four wall panels 18, 19, 20, and 21 by parallel score lines 22, 23 and 24 which (in conjunction with a glued paper strip 25) provide hinged joints that permit the sleeve S to be folded flat for bulk shipment from the supplier to the lamp manufacturer. The sleeve S preferably slightly exceeds the overall length of the lamp L so that the latter is completely disposed within the sleeve.

As will be noted in FIG. 1, the single-face corrugated paper stock from which the tubular sleeve S is made consists of the usual thin facing sheet 29 and a fluted sheet 30 that is glued to the face sheet and provides a series of spaced parallel corrugations 31 that extend along the inner surface of the sleeve at right angles to its longitudinal axis and that of the packed lamp L.

The desired tight frictional interlock between the inserted lamp L and the sleeve S is achieved in accordance with the present invention by an inturned hinged element such as an arcuate tab 26 that constitutes an integral part of one of the walls of the sleeve and is sandwiched between the lamp envelope 12 and the overlying adjoined part of the sleeve.

In the embodiment shown in FIG. 1, the inturned tab 26 is cut or "coined" from wall 19 of the sleeve S and is swingable along a hinge line H that is canted or skewed relative to the corrugations 31 of the sleeve S so that the corrugations 31' of the inturned tab 26 extend in a transverse direction relative to the corrugations 31 of wall 19 which they contact. The corrugations 31' of the inturned tab 26 accordingly do not nest with but bridge the corrugations 31 of the sleeve proper (as indicated by the phantom showing of the respective corrugations in FIG. 1), thus doubling the "effective" wall thickness of the sleeve S in this region and locally increasing its frictional "grip" on the lamp L.

The foregoing feature of the invention is shown more clearly in FIGS. 2 and 3. As will be noted in FIG. 2, the sleeve S according to this embodiment is of square cross-section and its walls 18–21 are so dimensioned that they are contiguous with and preferably effect a snug fit with the adjacent arcuate surfaces of the lamp L. As depicted in FIG. 3, the "two-ply" thickness of the sleeve S achieved by the inturned sandwiched tab 26 and the skewed non-nesting relationship of its corrugations 31' and the corrugations 31 of the overlying portion of the sleeve wall 19 automatically provides a tight fit at that location which partly collapses the corrugations and produces a slight bulging of the sleeve wall. The lamp L is thus securely anchored within the sleeve S.

As will be noted in FIG. 4, the tab 26 is preferably coined from the wall panel 19 by a pair of cut lines 33 and 34 that have arcuate end portions which terminate short of one another to provide a holding nick 35. The opposite ends of cut lines 33, 34 are joined by another cut line 36 and an aligned cut-score line 37 which form the canted hinge line H of the tab 26 referred to above.

As a specific example, excellent results have been obtained in the case of a 40 watt fluorescent lamp having a T12 type envelope (approximately 38 mm. in diameter) by using a square cross-sectioned sleeve S formed of single-face corrugated paper that was approximately 3.2 millimeters thick and had wall and tab components of the following dimensions (the various letters indicating the respective dimensions shown in FIG. 4):

TABLE I

| | |
|---|---|
| Length (N) of hold-down nick | 2.4 mm. |
| Radius of curvature (R) of tab end | 7.9 mm. |
| Length (T) of straight of tab | 20.6 mm. |
| Distance (V) from tab to side of wall | 6.4 mm. |
| Width (W) of wall panel | 38.9 mm. |
| Length (X) of hinged part of tab | 19.0 mm. |
| Length (Y) of base cut of tab | 9.5 mm. |
| Offset (Z) of hinge relative to sleeve corrugations | 9.5 mm. |

As illustrated in FIG. 5, the sleeve is preferably fabricated from a single piece or blank B of corrugated-paper stock that is suitably scored and cut automatically in accordance with well-known techniques to provide the hinged wall panels 18, 19, 20, 21 and tab 26 and also space the latter a predetermined distance inwardly from the end of the blank. As indicated in phantom, a second displaceable tab 32 can be provided at the other end of the blank B to permit the lamp L to be packed by inserting it into either end of the sleeve S.

As will be obvious to those skilled in the art, packaging of the lamps L in the factory is accomplished by merely erecting the collapsed sleeve S into its tubular form, pushing the tab 26 inwardly into the sleeve compartment (which forms an opening 28 in the sleeve as shown in FIG. 1), and then inserting the lamp L into that end of the sleeve S so that the lamp hits the inturned tab and swings in the same general direction as the longitudinal axis of the sleeve — thus automatically sandwiching it between the lamp envelope 12 and the wall 19 of the sleeve.

The invention is not limited to protective wrappers or sleeves of square cross-section but can be used with sleeves of the type described in the aforementioned U.S. patent to J. E. Mills et al. which are rectangular in cross-section. A lamp package P*a* having a modified sleeve S*a* of this construction is shown in FIG. 6 and, as will be noted, the sleeve has four hinged walls **18*a*, 19*a*, 20*a*, and 21*a* that are so paired and dimensioned that the sleeve has a major inside dimension that is larger than the diameter of the packed lamp L and a minor inside dimension that is less than the lamp diameter. As here shown, the oppositely-disposed pair of walls 18*a* and 20*a*** define the minor width dimension of the sleeve S*a* and one of these walls (wall **18*a* in this particular embodiment) is provided with a hinged inturned tab 26*a* that is sandwiched between the packed lamp L and the overlying portion of the wall 18*a***. The pressured frictional interlock in this region of the sleeve S *a* is accordingly intensified and (as illustrated) produces a more pronounced bulge on that side of the sleeve than the bulge which is produced on the opposite side by virtue of the tight-fitting rectangular cross-sectional configuration of the sleeve.

We claim as our invention:

1. A package comprising the combination of;

an elongated fragile article having a portion which is substantially circular in cross-section and defines the maximum lateral dimension of said article, a tubular open-ended sleeve of corrugated paper disposed in overlying protective relationship with said article and having a plurality of connected wall panels that are so shaped and arranged that at least two of said wall panels are contiguous with the said circular cross-sectioned portion of the article and are located on generally opposite sides thereof, means holding said wrapper in tubular configuration comprising a strip of material that is glued to and extends along the terminating longitudinal edges of a pair of adjacent wall panels, and means frictionally retaining said article within said open-ended sleeve consisting essentially of a hinged tab-like member that is cut from a medial part of and thus constitutes an integral segment of one of said contiguous wall panels, said tab-like member being displaced inwardly into the sleeve and disposed between the circular cross-sectioned portion of said article and the overlying adjoining portion of said one of said contiguous wall panels, the lateral dimension of the circular cross-sectioned portion of said article and the spacing between said two contiguous wall panels being so correlated relative to the thickness of said hinged tab-like member that said tab-like member is tightly sandwiched between the article and said one of said contiguous wall panels and thereby frictionally locks the article in pressured engagement with said sleeve and securely anchors said article in place therein.

2. The package of claim 1 wherein;

said tubular corrugated-paper sleeve has four wall panels and is of substantially uniform cross-sectional configuration throughout its length, and said fragile elongated article comprises an electric lamp.

3. The lamp package of claim 2 wherein;

said electric lamp has an envelope that is of tubular configuration and substantially uniform circular cross-section, the corrugations of said corrugated-paper sleeve extend transverse to the longitudinal axis of the sleeve, and said hinged tab-like locking member is so oriented relative to said sleeve that it is swingable in the same general direction as the longitudinal axis of said sleeve and, when inturned and pressed against said one of said contiguous wall panels, is positioned so that its corrugations extend transversely to and thus bridge the corrugations of the overlying portion of said one of said contiguous wall panels.

4. A lamp package comprising the combination of;

an electric lamp having an elongated fragile envelope, a portion whereof is substantially circular in cross-section and defines the maximum lateral dimension of said lamp, a tubular open-ended paper sleeve disposed in overlying protective relationship with said lamp and having a plurality of walls that are so shaped and arranged that at least two of said walls are contiguous with the said circular cross-sectioned portion of the lamp envelope, and means frictionally retaining said lamp within said open-ended sleeve comprising a hinged member that constitutes an integral part of one of said contiguous walls and is displaced inwardly into the sleeve and tightly sandwiched between the circular cross-sectioned portion of said lamp envelope and the overlying adjoining portion of said one of said contiguous walls, said tubular open-ended sleeve being fabricated from single-face corrugated paper and having four walls that are of substantially uniform width throughout their length so that said sleeve is thus of substantially uniform cross-section, the corrugations of said paper sleeve extending transverse to the lamp axis and comprising the inner surface of said sleeve, and said sandwiched retaining member comprising a tab that is swingable about a hinge line that is canted relative to the corrugations of said sleeve so that the corrugations of the inturned tab extend transversely to and thus do not nest with the corrugations of the inner surface of said sleeve which are in contact with the corrugations of said tab.

5. The lamp package of claim 4 wherein;

said electric lamp comprises a fluorescent lamp that has a tubular glass envelope of circular cross-section, the walls of said sleeve are so dimensioned and arranged that the sleeve is of substantially rectangular cross-section throughout its length and has an inside minor dimension that is less than the diameter of the lamp envelope so that said envelope is thereby in pressured engagement with oppositely disposed walls of the sleeve, and said retaining tab constitutes a part of one of said oppositely disposed walls of the sleeve.

6. The lamp package of claim 4 wherein;

said electric lamp comprises a fluorescent lamp that has a tubular glass envelope of circular cross-section, the walls of said sleeve are of substantially the same width and so arranged that the sleeve is of substantially square cross-section throughout its length, and the inside width dimension of said sleeve and the diameter of said lamp envelope are such that the walls of the sleeve contact the proximate arcuate surface of said envelope.

7. A wrapper for protectively packaging a fragile elongated article such as a fluorescent lamp or the like that is substantially circular in cross-section along at least a portion of its length, said wrapper comprising;

a tubular open-ended paper sleeve having four walls that define a single article-receiving compartment the minimum inside width dimension whereof does not exceed the maximum diameter of the circular cross-sectioned portion of the article to be packaged, and a hinged inwardly displaceable tab-like member that is cut from one of said walls and, when swung inwardly into overlapped relationship therewith, locally reduces the minimum inside width dimension of the sleeve and thus serves as an integral means for frictionally engaging an inserted article and locking it within said sleeve, said sleeve being fabricated from single-face corrugated paper the corrugated side whereof comprises the inner surface of the sleeve and is so oriented that the corrugations extend substantially normal to the longitudinal axis of the sleeve, and said tab-like locking member being swingable about a hinge line that is skewed relative to said corrugations.

8. The protective wrapper of claim 7 wherein;

said sleeve is collapsible, and said tab-like locking member is spaced inwardly from the ends of said sleeve and the side edges of the wall from which it is cut.

9. The protective wrapper of claim 7 wherein said walls and tab-like locking member constitute parts of an integral cut-and-scored blank.

* * * * *